US005678246A

United States Patent [19]

Cooley et al.

[11] Patent Number: 5,678,246

[45] Date of Patent: Oct. 21, 1997

[54] TWO-PIECE SWIMSUIT WITH BUILT-IN BRA

[76] Inventors: Pearl V. Cooley, R.D. 1, Box 1138; Kathryn A. Jackson, 9 Franklin St., P.O. Box 63, both of Brandon, Vt. 05733

[21] Appl. No.: 614,676

[22] Filed: Mar. 13, 1996

[51] Int. Cl.[6] ..... A41D 7/00

[52] U.S. Cl. ..... 2/67; 2/69; 450/30; 450/31; 450/22

[58] Field of Search ..... 2/67, 115, 104, 2/108, 69; 450/30, 31, 22

[56] References Cited

U.S. PATENT DOCUMENTS

| | | | |
|---|---|---|---|
| 3,255,754 | 6/1966 | Brumberger | 2/67 |
| 3,392,730 | 7/1968 | Relli | 2/67 |
| 4,956,878 | 9/1990 | Boynton | 2/67 |
| 5,033,986 | 7/1991 | Feigenbaum et al. | 2/67 |
| 5,119,511 | 6/1992 | Packer et al. | 2/67 |
| 5,478,278 | 12/1995 | Greenblatt | 2/67 |

*Primary Examiner*—Gloria Hale

[57] ABSTRACT

A swimsuit with a built-in bra further including a lower pants portion having an enlarged upper waist opening, two smaller lower leg openings, the lower pants portion being fabricated of a flexible elastomeric material with a built-in elastic waistband sewn into the circumference of the upper waist opening; a bra having a front and a back and having straps positionable over the shoulders of a wearer with oppositely disposed arm openings and an enlarged lower opening positionable about a wearer beneath the arm openings and above the waist opening, the bra being fabricated with two adjacent cups in the front for supporting the breast of a full-figured woman, the bra also having a back strap with centrally disposed fasteners for the putting on and taking off of the bra; and a lower stitching secured to the lower edge of the bra to couple it with a central extent of the upper portion beneath the breasts of a woman and above the waist opening of the upper portion, and upper stitching securing the upper periphery of the upper portion of the bra around the arm and neck openings to generate a secured eriphery in the upper portion around the periphery up all the openings of the upper portion.

1 Claim, 2 Drawing Sheets

TWO-PIECE SWIMSUIT WITH BUILT-IN BRA

BACKGROUND OF THE INVENTION

1. Field of the Invention

The present invention relates to a two piece swimsuit with built-in bra and more particularly pertains to clothing and supporting full-figured women.

2. Description of the Prior Art

The use of swimsuit and other garments for full-figured women of various designs and configurations is known in the prior art. More specifically, swimsuit and other garments for full-figured women of various designs and configurations heretofore devised and utilized for the purpose of clothing and providing support to particularly full-figured women through various methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,656,669 to Beard discloses a versatile bathing suit. U.S. Pat. No. 4,301,545 to Camarena discloses an adjustable swimsuit. U.S. Pat. No. 4,571,742 to Wior discloses a swimsuit. U.S. Pat. No. 4,654,894 to Kudo discloses a swimsuit. Lastly, U.S. Pat. No. 5,119,511 to Packer et al. discloses a swimsuit with bust control.

While these devices fulfill their respective, particular objectives and requirements, the aforementioned patents do not describe two piece swimsuit with built-in bra that allows the clothing and supporting of full-figured women.

In this respect, the two piece swimsuit according to the present invention substantially departs from the conventional concepts and designs of the prior art, and in doing so provides an apparatus primarily developed for the purpose of clothing and supporting full-figured women.

Therefore, it can be appreciated that there exists a continuing need for a new and improved two piece swimsuit with built-in bra which can be used for clothing and supporting full-figured women. In this regard, the present invention substantially fulfills this need.

SUMMARY OF THE INVENTION

In view of the foregoing disadvantages inherent in the known types of swimsuit and other garments for full-figured women of various designs and configurations now present in the prior art, the present invention provides an improved two piece swimsuit with built-in bra. As such, the general purpose of the present invention, which will be described subsequently in greater detail, is to provide a new and improved two piece swimsuit with built-in bra and method which has all the advantages of the prior art and none of the disadvantages.

To attain this, the present invention essentially comprises a new and improved two piece swimsuit with built-in bra for full-figured woman comprising a lower pants portion having an enlarged upper waist opening, two smaller lower leg openings, the lower pants portion being fabricated of a flexible elastomeric material with a built-in elastic waistband sewn into the circumference of the upper waist opening; an upper shirt portion having an enlarged lower waist opening with a built-in elastic waistband sewn into the circumference of the lower waist opening and overlapping the elastic waistband of the bottom portion during use, the upper portion also having small oval arm openings on the opposite sides with a centrally located neck opening therebetween, the upper portion being fabricated of a flexible elastomeric material; a bra having a front and a back and having straps positionable over the shoulders of a wearer with oppositely disposed arm openings and an enlarged lower opening the waist opening, the bra being fabricated with two adjacent positionable about a wearer beneath the arm openings and above the waist opening, the bra being fabricated with two adjacent cups in the front for supporting the breast of a full-figured woman, the bra also having a back strap with centrally disposed fasteners for the putting on and taking off of the bra; and a lower stitching secured to the lower edge of the bra to couple it with a central extent of the upper portion beneath the breasts of a woman and above the waist opening of the upper portion, and upper stitching securing the upper periphery of the upper portion of the bra around the arm and neck openings to generate a secured periphery in the upper portion around the periphery up all the openings of the upper portion.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved two piece swimsuit with built-in bra which has all of the advantages of the prior art swimsuit and other garments for full-figured women of various designs and configurations and none of the disadvantages.

It is another object of the present invention to provide a new and improved two piece swimsuit with built-in bra which may be easily and efficiently manufactured and marketed.

It is further object of the present invention to provide a new and improved two piece swimsuit with built-in bra which is of durable and reliable constructions.

An even further object of the present invention is to provide a new and improved two piece swimsuit with built-in bra which is susceptible of a low cost of manufacture with regard to both materials and labor, and which accordingly is then susceptible of low prices of sale to the consuming public, thereby making such two piece swimsuit with built-in bra economically available to the buying public.

Still yet another object of the present invention is to provide a new and improved two piece swimsuit with built-in bra which provides in the apparatuses and methods of the prior art some of the advantages thereof, while simultaneously overcoming some of the disadvantages normally associated therewith.

Even still another object of the present invention is to provide a two piece swimsuit with built-in bra for clothing and supporting full-figured women.

Lastly, it is an object of the present invention to provide a new and improved swimsuit with a built-in bra further including a lower pants portion having an enlarged upper waist opening, two smaller lower leg openings, the lower pants portion being fabricated of a flexible elastomeric material with a built-in elastic waistband sewn into the circumference of the upper waist opening; a bra having a front and a back and having straps positionable over the shoulders of a wearer with oppositely disposed arm openings and an enlarged lower opening positionable about a wearer beneath the arm openings and above the waist opening, the bra being fabricated with two adjacent cups in the front for supporting the breast of a full-figured woman, the bra also having a back strap with centrally disposed fasteners for the putting on and taking off of the bra; and a lower stitching secured to the lower edge of the bra to couple it with a central extent of the upper portion beneath the breasts of a woman and above the waist opening of the upper portion, and upper stitching securing the upper periphery of the upper portion of the bra around the arm and neck openings to generate a secured periphery in the upper portion around the periphery up all the openings of the upper portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
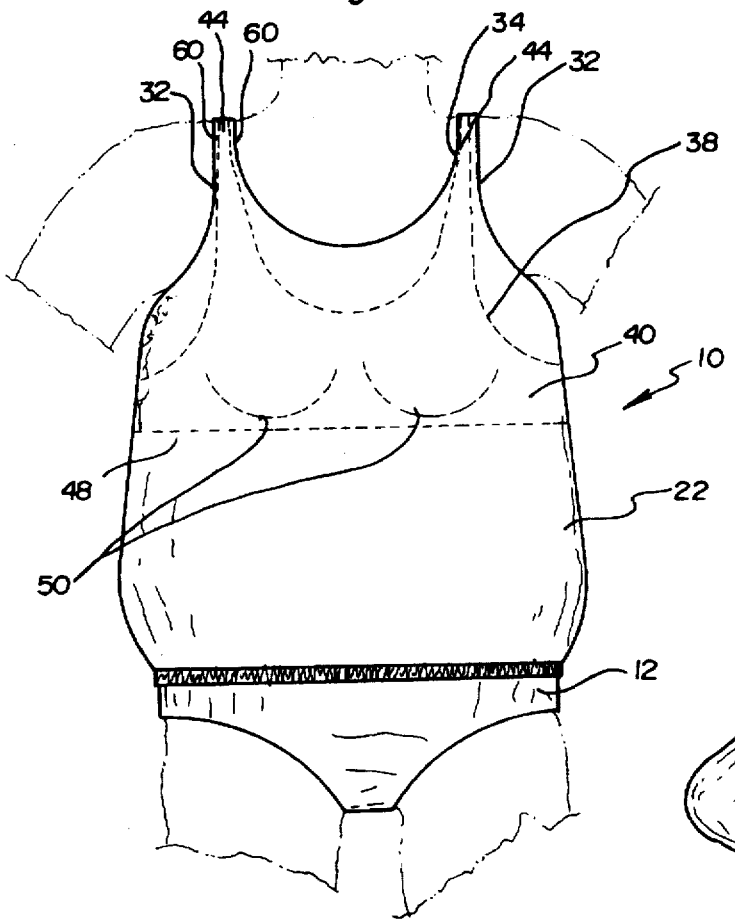
FIG. 1 is a front elevational view of the preferred embodiment of two-piece swimsuit constructed in accordance with the principles of the present invention.
Figure 2:
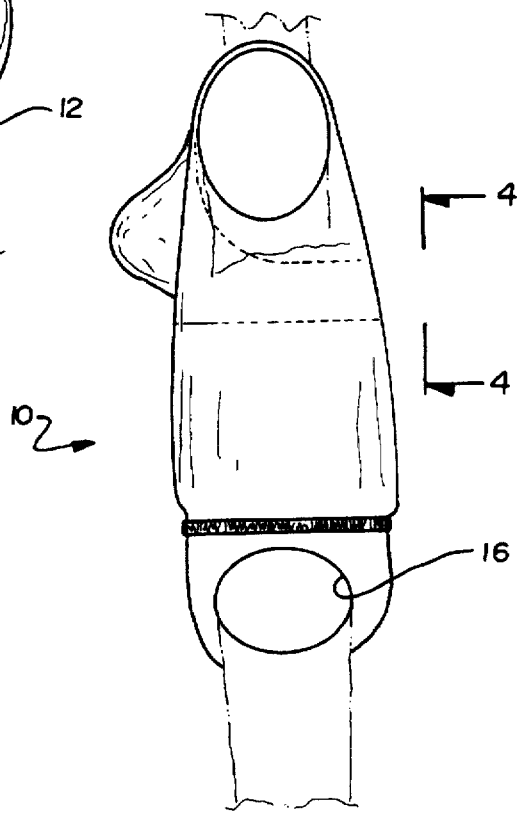
FIG. 2 is a side elevational view of the garment shown in FIG. 1.
Figure 4:
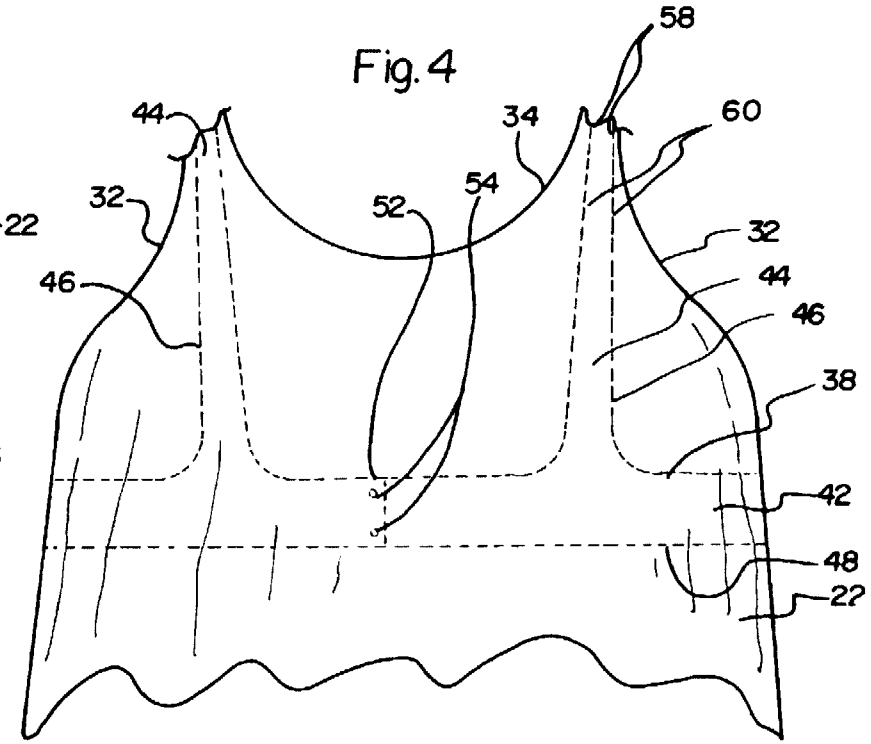
FIG. 4 is a rear elevational view of the upper portion of the garment shown in the prior Figures.
Figure 3:
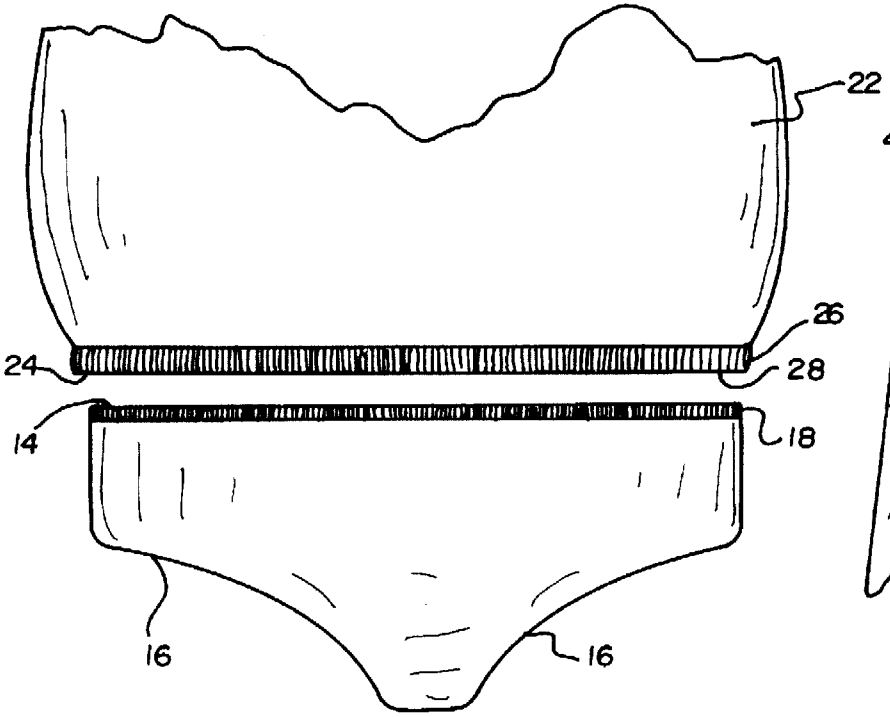
FIG. 3 is an enlarged front elevational view of the area between the garment components shown in FIGS. 1 and 2.

With reference now to the drawings, and in particular to FIG. 1 thereof, the preferred embodiment of the new and improved two piece swimsuit with built-in bra embodying the principles and concepts of the present invention and generally designated by the reference numeral 10 will be described.

The present invention, the two-piece swimsuit 10 is comprised of a plurality of components Such components in their broadest context include a lower pants portion, leg openings, elastic waistband, a bra and stitching. Such components are individually configured and correlated with respect to each other so as to attain the desired objective.

Specifically, the swimsuit of the present invention constitutes a system 10. One of the two central components of such system is the lower pants portion 12. Such pants portion includes an enlarged upper waist opening 14. It also includes two small leg openings 16. The lower pants portion is preferably fabricated of a flexible elastomeric material. It also includes a built-in elastic waistband 18. Such waistband is sewn or otherwise formed into the circumference of the upper waist opening.

The second major component of the system 10 of the present invention is an upper shirt portion 22. The upper shirt portion has an enlarged lower waist opening 24. Such waist opening is provide with an elastic waist opening is provided with an elastic waistband 26. The waistband is provided with built-in elastic 28. Such is sewn into the circumference of the lower waist opening. During operation and use, the waistband of the upper shirt portion is adapted to overlap the elastic waistband of the bottom portion.

The upper portion also includes small oval arm openings 32 on opposite sides. In association therewith is a centrally located neck opening 34 between the arm openings. The upper portion is also fabricated of a material similar to the lower portion such as flexible elastic material. It is preferably colored coordinated either of a single color or a design which is similar to or contrasting with the lower pants portion.

The last major component of the system 10 is a bra 38. Such bra has a front 40 and a back 42. It also has shoulder straps 44. The shoulder straps are positioned over the shoulders of a wearer. The shoulder straps form a pair of oppositely disposed arm openings 46. Between the shoulder straps is an enlarged opening 48 positionable about the wearer beneath the arm openings and above the waist opening. The bra is preferably fabricated with two adjacent cups 50 in the front of the bra. Such cups are for supporting the breasts of a full-figured woman. The bra is also provided with a back strap 52. The back strap is formed with centrally disposed fasteners 54 to assist in putting on and taking off the bra.

The last element of the system 10 of the present invention is stitching 58 for coupling of the bra to the upper shirt component. Such stitching includes portions secured to the lower edge of the bra to couple such areas with a central extent of the upper portion in the region beneath the breasts of a wearer and above the waist openings of the upper portion. In addition, upper stitching 60 is provided for securing the periphery of the upper portion of the bra around the arm and neck openings. This is to generate a secure periphery in the upper portion around the periphery of all openings of the upper portion.

The present invention is a two-piece swimsuit for full-figured women. The swimsuit is constructed in two pieces, a tank top with a full bra support and a hem, and a brief style bottom with an elastic waistband. This swimsuit is made with a regular bra sewn right inside the tank top. With this construction, the present invention would provide maximum support to full-figured women. With the support, full-figured women will feel more comfortable when active in such settings as public beaches and pools. This suit can come in a variety of colors and designs to meet anyone's personal style.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A two piece swimsuit with built-in bra for full-figured women comprising, in combination:

a lower pants portion having an enlarged upper waist opening, two smaller lower leg openings, the lower pants portion being fabricated of a flexible elastomeric material with a built-in elastic waistband sewn into the circumference of the upper waist opening;

an upper shirt portion having opposite sides and an enlarged lower waist opening with a built-in elastic waistband sewn into the circumference of the lower waist opening and overlapping the elastic waistband of the lower pants portion during use, the upper shirt portion also having small oval arm openings on the opposite sides with a centrally located neck opening therebetween, the upper shirt portion being fabricated of a flexible elastomeric material;

a bra having a front and a back and having straps positionable over the shoulders of a wearer with oppositely disposed arm openings and an enlarged lower opening positionable about a wearer beneath the arm openings and above the lower waist opening of the upper shirt portion, the bra being fabricated with two adjacent cups in the front for supporting the breasts of a full-figured woman, the bra also having a back strap with centrally disposed fasteners for the putting on and taking off of the bra; and a lower stitching secured adjacent to the lower opening of the bra to couple it with a central extent of the upper shirt portion beneath the breasts of a woman and above the lower waist opening of the upper portion, and upper stitching securing the upper periphery of the upper portion of the bra around the arm and neck openings to generate a secured periphery in the upper portions of the bra and the upper shirt around the periphery of all the openings of the upper portions of the bra and upper shirt.

* * * * *